US006123778A

United States Patent [19]

Quitberg

[11] Patent Number: 6,123,778

[45] Date of Patent: Sep. 26, 2000

[54] METHOD OF MECHANICALLY CLEANING PIPE

[76] Inventor: Kevin B. Quitberg, 610 Saratoga, Green River, Wyo. 82935

[21] Appl. No.: 09/196,635

[22] Filed: Nov. 19, 1998

[51] Int. Cl.[7] ..... B08B 9/04

[52] U.S. Cl. ..... 134/8; 134/22.11; 134/22.12

[58] Field of Search ..... 134/8, 22.11, 22.12; 15/104.09, 104.095

[56] References Cited

U.S. PATENT DOCUMENTS

| | | | |
|---|---|---|---|
| 4,011,100 | 3/1977 | Ross | 134/8 |
| 4,528,041 | 7/1985 | Rickey et al. | 134/8 |
| 5,244,505 | 9/1993 | Allison et al. | 134/22.11 |
| 5,472,514 | 12/1995 | Grimsley | 134/8 |
| 5,580,393 | 12/1996 | Lawther | 134/8 |

*Primary Examiner*—Randy Gulakowski
*Assistant Examiner*—Saeed Chaudhry
*Attorney, Agent, or Firm*—Terry M. Crellin

[57] ABSTRACT

A method of cleaning a linear discharge pipe that extends from a tank to a valve comprises attaching a cleaning apparatus to the discharge side of the valve on the discharge pipe. The valve is then opened and a rotating cutter head on the cleaning apparatus is advanced through the open valve and the discharge pipe until the cutter head has traversed the entire length of the discharge pipe. The rotating cutter head is then withdrawn back through the discharge pipe and the open valve. The valve is then closed and the cleaning apparatus is removed from the discharge side of the valve. Any portion of downstream piping that had been removed to allow access to the valve is then reinstalled to the discharge side of the valve.

6 Claims, No Drawings

METHOD OF MECHANICALLY CLEANING PIPE

BACKGROUND OF THE INVENTION

1. Field of the Invention

The present invention relates to methods of mechanically cleaning pipe, and in particular to methods of cleaning pipe that extends from a tank containing a liquid to a valve, wherein the pipe is cleaned while liquid remains in the tank.

2. State of the Art

It is common in chemical plants to clean piping using a chemical such as an acid. However, to utilize a chemical cleaning method, the piping, tanks and other apparatus associated with the piping must first have all the liquid normally carried by the piping drained from the system. This requires that the piping and associated apparatus must be taken out of operation. The downtime to remove the apparatus from operation is costly. Mechanical cleaning of piping has also been used, but, again, the piping and associated piping has had to be drained of liquid which requires the piping and associated equipment must be removed from normal operation.

The problem with cleaning pipes that connect between a tank and a pump is especially acute. In many pumping applications, a precipitate is formed in both suction and discharge portions of the pipe associated with the pump. As mentioned previously, the precipitate can be removed with acid in some applications. It can also be removed with high pressure water (hydro-blasting). Aside from the problem of downtime associated with acid cleaning and hydro-blasting, another problem with such methods is that the methods are often precluded from being used because of accessibility of the piping, chemical reaction, and product dilution.

Precipitate formation usually occurs most rapidly in areas where laminar flow is disturbed or a temperature change is induced. This is often in the suction area of piping supplying liquid to a pump. A particularly problematic area is the pipe from a tank providing fluid to a pump. Scale will form in the pipe in the area between the tank wall and the valve used to isolate the pump's suction from the tank.

Cleaning the section of piping between the valve and the tank is usually very difficult, especially if attempted while the tank remains filled with its normal liquid contents. Introduction of acid into the section of pipe will dilute the liquid contents of the tank and can be very hazardous in many situations. Further, retention time for the acid in the piping generally does not allow sufficient time for adequate scale removal unless the tank and piping are first drained of their normal contents and acid is allowed to stand or circulate through the tank and piping.

High pressure introduction of fluid into the section of pipe between the valve and the tank has also been suggested. However, the high pressure fluid can only clean a few inches of the section of pipe inasmuch as the resistance of the fluid in the section of pipe reduces the velocity of the high pressure fluid rapidly. In addition, there is no way to check visually to assure that the section of pipe is truly free of scale.

Because of the problems associated with attempts to clean sections of piping between a tank and a valve while the tank remains filled with its normal liquid contents, it has been customary to pump the tank down to a low level. The tank is then physically entered through the side or top of the tank with mobile equipment to remove scale with a mechanical hammer, i.e., a jack-hammer. As mentioned previously, costly downtime is associated with draining, entering, cleaning, closing and re-filling a tank. It would be highly desirable to provide a method of cleaning the sections of piping between a tank and a valve on the suction side of a pump while the tank remains full of its normal liquid contents so as to avoid costly downtime.

OBJECTIVES AND BRIEF DESCRIPTION OF THE INVENTION

A principal objective of the invention is to provide a novel method of mechanically cleaning a section of pipe while the section of pipe remains filled with fluid.

A further objective of the present invention is to provide such a method that uses a mechanically driven rotary cutter to effect essentially total removal of scale from the section of pipe.

A still further objective of the present invention is to provide such a method of using a mechanically driven rotary cutter to clean a section of pipe from a tank to a valve on the suction side of a pump while the tank and line remain filled with the fluid normally contained in the tank.

The above objectives are achieved in accordance with the present invention by providing a novel method for mechanically cleaning a linear section of pipe. The method is particularly advantageous in cleaning a section of pipe that extends from a tank to a valve on the suction side of a pump used to draw liquid from the tank. The method of the present invention is particularly applicable to cleaning of pump suction piping systems in which the valve is of a type in which an opening extends linearly through the valve when the valve is open. The opening must be essentially as large as the cross-sectional size of the discharge pipe. Further, the opening must be in axial alignment with the discharge pipe. The method of the present invention is capable of cleaning of such discharge pipe while liquid remains in the tank, i.e., the tank does not have to be pumped down, and if an auxiliary pump is attached through its own suction piping to the tank, the tank can continue to be utilized while the suction piping to the principal pump is being cleaned.

The novel method of the present invention comprises the steps of (a) closing the valve;

(b) removing a portion of a downstream piping system that is connected to the discharge side of the valve so as to provide working access to the discharge side of the valve;

(c) attaching a cleaning apparatus to the discharge side of the valve, wherein the cleaning apparatus has a rotating cutter head that has a diameter essentially the same as an inside diameter of the discharge pipe from the tank, with the rotating cutter head being positioned in axial alignment with the discharge pipe when the cleaning apparatus is attached to the valve;

(d) creating a seal between the cleaning apparatus and the discharge side of the valve to inhibit leaking of liquid from the seal when the valve is open;

(e) opening the valve;

(f) advancing the rotating cutter head of the cleaning apparatus through the opening in the valve and into the discharge pipe;

(g) continuing to advance the rotating cutter head through the discharge pipe until the cutter head has traversed the entire length of the discharge pipe;

(h) withdrawing the rotating cutter head back through the discharge pipe and the opening in the valve;

(i) closing the valve;

(j) removing the cleaning apparatus from the discharge side of the valve; and (k) re-installing the portion of the downstream piping system that was removed in step (b) to the discharge side of the valve.

It is advantageous to also introduce a flow of liquid through the cleaning apparatus into the discharge pipe at the valve continuously as the rotating cutter head is advanced through the opening in the valve and into the discharge pipe in step (f) as well as when the rotating cutter head continues to advance through the discharge pipe in step (g). The liquid introduced through the cleaning apparatus is preferably the same liquid as that contained in the tank, and if the tank has an auxiliary pump, the liquid can be taken from the discharge of the auxiliary pump. Cuttings of scale deposits that are removed from the interior of the discharge pipe by the cutter head are flushed back into the tank continuously during the cleaning of the discharge pipe.

It is also advantageous to provide a discharge valve on the cleaning apparatus at a position adjacent to the valve when the cleaning apparatus is attached to the valve. This discharge valve is advantageously opened during at least the last several inches of the withdrawing of the cutter head in step (h) to flush out any cuttings of scale deposits that have migrated behind the cutter head.

As mentioned previously, the method of the present invention is particularly adapted to mechanically clean the linear discharge pipe when the valve at the suction side of the pump is of the type that has a linear opening extending through the valve when the valve is open. However, the method of the present invention can be modified to be utilized to mechanically clean a linear discharge pipe that extends from a tank to a valve at the suction side of a pump even when the valve is of a type in which an opening extends through the valve when the valve is open is not as large as the cross-sectional size of the discharge pipe and/or the opening is not in axial alignment with the discharge pipe.

When the suction piping from the tank includes such a non-conforming valve, additional steps must be undertaken to replace the non-conforming valve prior to the cleaning of the discharge pipe from the tank. The non-conforming valve must be closed, and then a hot tap is made in the discharge pipe adjacent to the connection of the non-conforming valve to the discharge pipe. A non-inflated bladder is introduced into the discharge pipe through the hot tap, and the bladder is inflated to temporarily block the discharge pipe upstream from the non-conforming valve. The non-conforming valve and a portion of a downstream piping system that is connected to the discharge side of the non-conforming valve is then removed from the discharge pipe so as to provide working access to a downstream end of the discharge pipe.

After the non-conforming valve has been removed, a replacement valve is attached to the downstream end of the discharge pipe, wherein the replacement valve is of a type in which an opening extends through the replacement valve when the replacement valve is open, with the opening in the replacement valve being at least as large as the cross-sectional size of the discharge pipe and with the opening in the replacement valve being in axial alignment with the discharge pipe. The replacement valve is closed and then steps (b) through (k) of the method of the present invention as previously described are performed. The supplemental steps of (1) introducing a flow of liquid through the cleaning apparatus to flush cuttings of scale deposits back into the tank and (2) opening a discharge valve on the cleaning apparatus to flush out any cuttings of scale deposits that have migrated behind the cutter head can also be performed. These supplemental steps are described fully hereinabove.

Additional objects and features of the invention will become apparent from the following detailed description.

DETAILED DESCRIPTION OF PREFERRED EMBODIMENTS

The novel method of the present invention is ideally suited to cleaning of pipes from a tank that is full of liquid, without requiring draw down of liquid from the tank. Normal operation of the tank can continue with no downtime if spare pumping is available. The suction piping to the principal pump can be cleaned to restore unrestricted flow to the pump suction while the tank continues in normal operation utilizing a backup or spare pump. The piping to the principal pump can be cleaned while the backup or spare pump is in operation. With suction flow restored to the principal pump, cleaning can proceed to the piping of the backup or spare pump if necessary. The method of the present invention allows a cleaning strategy to be used prior to badly restricted lines affecting pump performance, and operations personnel are able to assure themselves of a situation in which fluid movement integrity is maintained at an optimum level with no losses in production.

Initial determinants for cleaning include pumps that still cavitate when NPSH requirements are being met and temperature differential between the O.D. of the piping adjacent to the tank and the temperature of the fluid being pumped is abnormal. Experience has shown that a 30 degree Fahrenheit differential equates with flow-restricting scaling.

After determining that a pipe is scaled and needs cleaning, space and valve requirements must be met. It has been found that the space needed for implementation of the method of the present invention is approximately 50 or more inches between the valve face and the pump motor to allow mounting of the cleaning apparatus to the valve face. Valves such as knife gate valves, gate valves and plug valves that have a linear opening extending through the valve when the valve is open, with the opening further being essentially as large as the cross-sectional size of the pipe that is to be cleaned are ideally suited to the present method. Valves such as globe valves and butterfly valves that do not have openings that extend linearly through the valve and/or do not have openings essentially as large as the cross-sectional size of the pipe will require a modification to the method of the present invention. The modification will be discussed hereinafter.

The cleaning apparatus used has a rotating cutter head that has a diameter essentially the same as the inside diameter of the pipe that is to be cleaned. The rotating cutter head is attached to a drive shaft that extends through a bushing bearing of a flange. The drive shaft rotates in the bushing bearing and can be advanced through the bushing bearing and the flange. The distal end of the drive shaft is attached to a drive mechanism, and the mechanism is mounted so that it can be advanced toward the bushing bearing in the flange.

The flange of the cleaning apparatus is attached to the valve face after the valve has been closed and the downstream portion of the piping between the valve and the pump have been removed to allow access to the valve face. Removal of the pump suction spool piece will usually provide the necessary access to the valve face. Occasionally, the pump wet end or the entire pump assembly may need to be removed. Once the flange of the cleaning apparatus has been attached to the valve face, the cutter head will be positioned within the opening in the valve adjacent to the valve face. The flange of the cleaning apparatus is tightened to the valve face so as to create a liquid tight seal between the cleaning apparatus and the discharge of the valve to inhibit leaking of liquid from the seal when the valve is subsequently opened.

After the flange of the cleaning apparatus has been securely attached to the valve face, the valve is opened and rotation of the cutter head is initiated. The drive mechanism for the shaft of the cutter head is then activated to advance the rotating cutter head through the valve and into the discharge pipe upstream of the valve. Advancing of the cutter head through the discharge pipe is continued until the cutter head has traversed the entire length of the discharge pipe.

Should the limit of travel of the drive shaft of the drive mechanism toward the flange of the cleaning apparatus be reached prior to the advancement of the cutter head through the length of discharge pipe, the drive mechanism is then disconnected from the drive shaft and retracted. A shaft extension is then connected between the distal end of the drive shaft and the drive mechanism, whereupon the drive mechanism is again activated to rotate the cutter head and advance the cutter head through the pipe being cleaned. If necessary, this procedure of adding shaft extensions to the drive shaft can be repeated as necessary to clean the entire length of the pipe.

When the scale removal has been completed from the entire length of the pipe being cleaned, the cutter head is retracted through the cleaned pipe and the opening in the valve by withdrawing the drive shaft and drive mechanism. If shaft extensions had been added to the drive shaft during the cleaning operation, then they are simply removed from the shaft during the withdrawing of the cutter head through the cleaned pipe and the valve. Once the cutter head is positioned adjacent to the valve face, the valve is closed and the cleaning apparatus is removed from the discharge side of the valve. The portion of the downstream piping system that was removed to provide working access is then re-installed. If the pump wet end or the entire pump assembly was removed to provide working access, they must, of course, be re-installed also.

If the valve on the piping to be cleaned is of a type that the opening is not linear, not in axial alignment with the pipe to be cleaned or is not as large as the cross-sectional size of the discharge pipe, the method of the present invention is modified to replace the non-conforming valve with an appropriate conforming valve prior to the attachment of the cleaning apparatus to the system. In the modified method, the non-conforming valve is closed and a hot tap is made in the discharge pipe adjacent to the connection of the non-conforming valve to the discharge pipe.

A non-inflated bladder is inserted into the discharge pipe through the hot tap and the bladder is inflated to temporarily block the discharge pipe upstream from the non-conforming valve. The non-conforming valve and a portion of a downstream piping system that is connected to the discharge side of the non-conforming valve is removed so as to provide working access to a downstream end of the discharge pipe.

A replacement valve is attached to the downstream end of the discharge pipe, wherein the replacement valve is a conforming valve in which an opening extends through the replacement valve when the replacement valve is open, with the opening in the replacement valve being essentially as large as the cross-sectional size of the discharge pipe and with the opening in the replacement valve being in axial alignment with the discharge pipe. The cleaning apparatus is then attached to the discharge side of the replacement valve. The bladder is deflated and removed from the pipe and the cleaning method as described above for a conforming valve is followed.

In either of the above described procedures, i.e., cleaning a system having a conforming valve as an initial component of the system or cleaning a system in which a non-conforming valve is replaced by a conforming valve, it is advantageous to introduce a flow of liquid through the cleaning apparatus into the discharge pipe at the valve continuously as the rotating cutter head is advanced through the opening in the valve and into and through the discharge pipe that is being cleaned. The flow of liquid back flushes cuttings of scale deposits removed from the interior of the discharge pipe into the tank continuously during the cleaning of the discharge pipe.

In either of the two above described procedures, a discharge valve is preferably provided on the cleaning apparatus at a position adjacent to the valve, and the discharge valve is opened during at least the last several inches of the withdrawing of the cutter head after the pipe has been cleaned. Opening the discharge valve allows any cuttings of scale deposits that have migrated behind the cutter head to be discharged.

The method of the present invention can also be modified to mechanically clean a linear pipe that is used to convey liquid but is not connected in the near vicinity to a suction of a pump. In this latter modification, a short portion of the pipe to be cleaned is removed so as to provide working access to an open end of the pipe. The cleaning apparatus is attached to the open end of the pipe. The cleaning apparatus is essentially the same as described previously.

The cleaning apparatus can be attached to a flange on the open end of the pipe in those instances where a flange is located immediately upstream of the short portion of pipe that is to be removed. If there is no flange in the piping, or the piping is to be cleaned in both directions from the short portion of pipe that is removed, then it is advantageous to insert a non-inflated bladder through a hot tap in the piping upstream of the short portion that is to be removed. The bladder is inflated and a flange is installed on any exposed end of the piping that does not already have a flange after the short portion of the pipe has been removed. The cleaning apparatus is then attached to a flange on the end of the piping to be cleaned, and the cleaning method as described above for cleaning a discharge pipe from a tank is followed. After cleaning the piping, the short portion of pipe that was removed previously is re-installed.

A flow of liquid is advantageously introduced through the cleaning apparatus into the pipe being cleaned continuously as the rotating cutter head is advanced through the pipe to flush cuttings of scale deposits removed from the interior of the pipe back through the pipe. The short portion of pipe that is removed to provide access to the pipe to be cleaned can, of course, be cleaned before it is re-installed. A discharge valve is advantageously provided on the cleaning apparatus, and the discharge valve is opened during at least the last several inches of the withdrawing of the cutter head from the cleaned pipe to flush out any cuttings of scale deposits that have migrated behind the cutter head.

Although preferred embodiments of the method of cleaning a section of pipe in accordance with the present invention have been described, it is to be understood that the present disclosure is made by way of example and that various other embodiments are possible without departing from the subject matter coming within the scope of the following claims, which subject matter is regarded as the invention.

What is claimed is:

1. A method of mechanically cleaning a linear discharge pipe that extends from a tank containing liquid to a valve, wherein said valve is of a type in which an opening extends through said valve when said valve is open, with said opening being essentially as large as the cross-sectional size of said discharge pipe and with said opening being in axial alignment with said discharge pipe, said cleaning of said discharge pipe being accomplished while liquid remains in said tank, said method comprising the steps of (a) closing said valve;

(b) removing a portion of a downstream piping system that is connected to the discharge side of said valve so as to provide working access to the discharge side of said valve;

(c) attaching a cleaning apparatus to the discharge side of said valve, said cleaning apparatus having a rotating cutter head that has a diameter essentially the same as an inside diameter of the discharge pipe from the tank, with said rotating cutter head being positioned in axial alignment with said discharge pipe when said cleaning apparatus is attached to said valve;

(d) creating a seal between said cleaning apparatus and said discharge side of said valve to inhibit leaking of liquid from said seal when said valve is open;

(e) opening said valve;

(f) advancing the rotating cutter head of said cleaning apparatus through the opening in said valve and into said discharge pipe;

(g) continuing to advance said rotating cutter head through said discharge pipe until the cutter head has traversed the entire length of said discharge pipe;

(h) withdrawing said rotating cutter head back through said discharge pipe and said opening in said valve;

(i) closing said valve;

(j) removing said cleaning apparatus from the discharge side of said valve; and (k) re-installing the portion of said downstream piping system that was removed in step (b) to said discharge side of said valve.

2. The method of mechanically cleaning a linear discharge pipe that extends from a tank containing liquid to a valve in accordance with claim 1 further including the step of introducing a flow of liquid through said cleaning apparatus into said discharge pipe at said valve continuously as said rotating cutter head is advanced through the opening in said valve and into said discharge pipe in step (f) as well as when said rotating cutter head continues to advance through said discharge pipe in step (g), whereby cuttings of scale deposits removed from the interior of said discharge pipe are flushed back into said tank continuously during the cleaning of said discharge pipe.

3. The method of mechanically cleaning a linear discharge pipe that extends from a tank containing liquid to a valve in accordance with claim 2 wherein a discharge valve is provided on said cleaning apparatus at a position adjacent to said valve, and the discharge valve is opened during at least the last several inches of the withdrawing of the cutter head in step (h) to flush out any cuttings of scale deposits that have migrated behind the cutter head.

4. A method of mechanically cleaning a linear discharge pipe that extends from a tank containing liquid to a valve, wherein said valve is of a type in which an opening extends through said valve when said valve is open, but said opening is either not as large as the cross-sectional size of said discharge pipe or said opening is not in axial alignment with said discharge pipe, said cleaning of said discharge pipe being accomplished while liquid remains in said tank, said method comprising the steps of (a) closing said valve;

(b) making a hot tap in said discharge pipe adjacent to the connection of said valve to said discharge pipe;

(c) introducing an non-inflated bladder into said discharge pipe through said hot tap;

(d) inflating said bladder to temporarily block the discharge pipe upstream from said valve;

(e) removing said valve and a portion of a downstream piping system that is connected to the discharge side of said valve from said discharge pipe so as to provide working access to a downstream end of said discharge pipe;

(f) attaching a replacement valve to the downstream end of said discharge pipe, wherein said replacement valve is of a type in which an opening extends through said replacement valve when said replacement valve is open, with said opening in said replacement valve being essentially as large as the cross-sectional size of said discharge pipe and with said opening in said replacement valve being in axial alignment with said discharge pipe;

(g) attaching a cleaning apparatus to the discharge side of said replacement valve, said cleaning apparatus having a rotating cutter head that has a diameter essentially the same as an inside diameter of the discharge pipe from the tank, with said rotating cutter head being positioned in axial alignment with said discharge pipe when said cleaning apparatus is attached to said replacement valve;

(h) creating a seal between said cleaning apparatus and said discharge side of said replacement valve to inhibit leaking of liquid from said seal when said replacement valve is open;

(i) deflating said bladder and removing the deflated bladder from said discharge pipe;

(j) opening said replacement valve;

(k) advancing the rotating cutter head of said cleaning apparatus through the opening in said replacement valve and into said discharge pipe;

(l) continuing to advance said rotating cutter head through said discharge pipe until the cutter head has traversed the entire length of said discharge pipe;

(m) withdrawing said rotating cutter head back through said discharge pipe and said opening in said replacement valve;

(n) closing said replacement valve;

(o) removing said cleaning apparatus from the discharge side of said replacement valve; and (p) re-installing the portion of said downstream piping system that was removed in step (e) to said discharge side of said replacement valve.

5. The method of mechanically cleaning a linear discharge pipe that extends from a tank containing liquid to a valve in accordance with claim 4 further including the step of introducing a flow of liquid through said cleaning apparatus into said discharge pipe at said replacement valve continuously as said rotating cutter head is advanced through the opening in said replacement valve and into said discharge pipe in step (k) as well as when said rotating cutter head continues to advance through said discharge pipe in step (l), whereby cuttings of scale deposits removed from the interior of said discharge pipe are flushed back into said tank continuously during the cleaning of said discharge pipe.

6. The method of mechanically cleaning a linear discharge pipe that extends from a tank containing liquid to a valve in accordance with claim 5 wherein a discharge valve is provided on said cleaning apparatus at a position adjacent to said replacement valve, and the discharge valve is opened during at least the last several inches of the withdrawing of the cutter head in step (m) to flush out any cuttings of scale deposits that have migrated behind the cutter head.

* * * * *